US006296670B1

(12) United States Patent
Rusche et al.

(10) Patent No.: US 6,296,670 B1
(45) **Date of Patent: *Oct. 2, 2001**

(54) CHELATING AGENTS FOR IMPROVED COLOR FIDELITY

(75) Inventors: John Robert Rusche; Ellen Schmidt Baker, both of Cincinnati, OH (US); Axel Masschelein, Uccle (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/882,924

(22) Filed: Jun. 26, 1997

Related U.S. Application Data

(63) Continuation of application No. 08/753,167, filed on Nov. 21, 1996, now Pat. No. 5,686,376, which is a continuation of application No. 08/372,068, filed on Jan. 12, 1995, now abandoned.

(51) Int. Cl.[7] ..... C11D 1/62

(52) U.S. Cl. ..... 8/137; 252/8.91; 510/521; 510/522; 510/531; 510/533; 510/320; 510/321; 510/322; 510/327; 510/328; 510/329; 510/330

(58) Field of Search ..... 8/137; 510/521, 510/522, 531, 533, 320, 321, 322, 327, 328, 329, 330; 252/8.91

(56) References Cited

U.S. PATENT DOCUMENTS

| | | | | |
|---|---|---|---|---|
| H1468 | * | 8/1995 | Costa et al. | 510/101 |
| 3,756,950 | * | 9/1973 | Gluck | 510/521 |
| 4,326,965 | * | 4/1982 | Lips et al. | 510/522 |
| 4,525,291 | * | 6/1985 | Smith et al. | 510/108 |
| 4,702,857 | * | 10/1987 | Gossilink | 510/299 |
| 4,767,547 | * | 8/1988 | Straathof et al. | 510/522 |
| 4,810,413 | * | 3/1989 | Pancheri et al. | 510/320 |
| 5,399,272 | * | 3/1995 | Swartley et al. | 510/525 |
| 5,445,747 | * | 8/1995 | Kvietok et al. | 510/521 |
| 5,460,736 | * | 10/1995 | Trinh et al. | 510/521 |
| 5,686,376 | * | 11/1997 | Rusche et al. | 502/329 |

FOREIGN PATENT DOCUMENTS

185427 * 6/1986 (EP) .

* cited by examiner

*Primary Examiner*—Alan Diamond
(74) *Attorney, Agent, or Firm*—Robert B. Aylor

(57) ABSTRACT

Rinsing dyed or white fabrics in a chelator-containing rinse bath restores color and brightness. Rinse added compositions comprising chelators such as diethylenetriaminepentaacetate or ethylenediamine disuccinate are used to restore the appearance of colored and white fabrics whose drab appearance has been caused by interactions with metal ions, especially copper and nickel. Compositions comprising the chelators in combination with fabric care auxiliaries such as fabric softeners, cellulase enzymes and chlorine scavengers are provided.

12 Claims, No Drawings

CHELATING AGENTS FOR IMPROVED COLOR FIDELITY

CROSS-REFERENCE TO RELATED APPLICATIONS

This application is a continuation of our application Ser. No. 08/753,167, filed Nov. 21, 1996, now U.S. Pat. No. 5,686,376, which is a continuation of application Ser. No. 08/372,068, filed Jan. 12, 1995, now abandoned.

FIELD OF THE INVENTION

The present invention relates to processes for maintaining or restoring the colors or whiteness of fabrics during a rinsing operation.

BACKGROUND OF THE INVENTION

A wide variety of ingredients have been suggested for use in laundering operations to enhance the appearance of fabrics. Detergents, of course, provide a basic cleaning function. Rinse-added fabric softeners provide both softening and anti-static benefits to fabrics. More recently, cellulase enzymes have been employed to improve the appearance of colored cotton garments.

Formulators of fabric cleaning products have clearly recognized the need to improve the color fidelity of dyed fabrics. As noted above, the use of cellulase is one modern method for achieving this desirable result. Other formulators have approached this challenge from the standpoint of more effective cleaning. For example, various bleaches are advertised as being able to maintain color brightness. Another means for addressing the problem of color fidelity employs dye transfer inhibiting agents in the laundering liquor. This approach is based on the discovery that vagrant dyes present in the laundering liquor can undesirably redeposit onto fabrics, thereby gradually changing, and generally darkening, colors and whites. While the use of cellulases, dye transfer inhibiting agents and bleaches can meet certain consumer needs for maintaining color fidelity, there is a continuing search for improvements in this area.

The present invention addresses the problem of color fidelity in laundered fabrics from an entirely different aspect. It has now been determined that metal cations, especially transition metals, and most particularly copper and nickel ions, present in aqueous rinse baths can undesirably interact with fabric dyes and change their perceived hue. This also often translates into a darkening of the dye material, which tends to cause the colored fabrics to appear drab. Interactions of metal ions with residual soils may also tend to clear a drab appearance. While many conventional washing compositions contain metal ion sequestrants which may minimize this problem during the actual washing operation, it has heretofore been overlooked that the freshly laundered fabrics are subsequently subjected to aqueous rinse baths which do not contain such sequestrants. It has now been discovered that metal ions present in the rinse can also undesirably interact with dyed fabrics, resulting in a loss of color fidelity and brightness.

While not intending to be limited by theory, it may be speculated that functional substituent groups present in complex dye molecules bind with metal ions, thereby causing a change in color which is generally perceived as drabness and an overall appearance of fabric aging. This has now been found to occur with common ortho-hydroxy diazo dyes and with certain direct dyes. A similar undesirable interaction may also occur between metal cations and the "optical brighteners" which are commonly used to enhance the perception of whiteness and brightness of white fabrics, thereby resulting in reduced fluorescence of the fabrics. Whatever the reason for the drabness and change in appearance, it has now been discovered that such problems associated with loss of color fidelity can be overcome by the fabric treatment process herein which is conducted in the rinse bath.

By the practice of the present invention, dyed or white fabrics are rinsed in an aqueous rinse bath which contains a metal ion chelating agent. The chelating agent is present in an amount sufficient to scavenge metal ions, especially copper and nickel, thereby preventing undesirable metal interactions with dyes or optical brighteners. Moreover, the invention also can be used to remove metal ions which have already combined with dye or optical brightener molecules on fabrics in the laundering process, thereby providing a restorative benefit to colors which have become drab due to metal ion interactions, especially due to interactions with copper cations and nickel cations, but also manganese cations, iron cations, and transition metal cations, among others. These and other objects are secured by the present invention, as will be seen from the following disclosure.

BACKGROUND ART

The use of various chelators and polycarboxy ingredients for several disclosed purposes in laundry rinse additives or other products appears in: U.S. Pat. No. 3,756,950; U.S. Pat. No. 3,904,359; U.S. Pat. No. 3,954,630; DE 3,312,328; EP 165,138 (85:12:18); EP 168,889 (86:01:22); EP 271,004 (88:06:15); EP 534,009 (93:03:31; WO 9,306,294); CA 913,309 (00:01:00 priority 68:08:01 68CA-026,440); and JP HEI4 [1992] 275,956. See also Method AATCC-161-1992 "Chelating Agents: Disperse Dye Shade Change Caused by Metals; Control of". The preferred EDDS chelator used herein is described in U.S. Pat. No. 4,704,233.

SUMMARY OF THE INVENTION

The present invention encompasses a method for improving the color of dyed fabrics, or the whiteness of white fabrics, said fabrics having been laundered in the conventional manner in water which contains copper ions, nickel ions, or both, comprising rinsing said fabrics in water which contains chelating agents for copper and/or nickel cations.

In a convenient and preferred mode, the method herein involves a fabric washing/rinsing operation, comprising the steps of:

(a) washing fabrics with a laundry detergent composition; and (b) following said washing, rinsing said fabrics in water comprising at least about 2 ppm, preferably at least about 5 ppm, of a chelating agent or mixture of chelating agents for copper, nickel and mixtures thereof.

The method herein can be conducted under varying conditions, depending on such factors as the amount of copper and nickel metal ions present in the rinse water supply, the degree of prior dye or optical brightener interaction with metal ions, and the like. In a preferred mode, the dyed fabrics are immersed in the chelator-containing rinse water for a period of at least about 1 minute. The method can be conducted at a temperature in the range from about 5° C. to the boil.

In addition to the chelator, the method disclosed herein may be conducted in rinse water which additionally contains a member selected from the group consisting of fabric softeners, cellulase enzymes, chlorine scavengers, dye transfer inhibiting agent and mixtures thereof, thereby providing additional or improved fabric care and color care benefits. Preferred dye transfer inhibiting agents for such use include members selected from the group consisting of "PVP", "PVPVI" and "PVNO", as described hereinafter. Preferred chlorine scavengers for such use include members selected from the group consisting of ammonium chloride and monoethanolamine. Preferred fabric softeners for such use include any of the known cationic softeners, especially those disclosed hereinafter. Preferred cellulase enzymes for such use include cellulases derived from fungi. A highly preferred cellulase is CAREZYME from NOVO.

The invention herein also encompasses compositions comprising the chelating agents and other ingredients noted above, and disclosed in more detail hereinafter.

All percentages, ratios and proportions herein are by weight, unless otherwise specified. All documents cited are, in relevant part, incorporated herein by reference.

DETAILED DESCRIPTION OF THE INVENTION

The present invention is employed to provide improved color fidelity to fabrics. By "improved color fidelity" or "improving the color" of the fabrics herein is meant not only the maintenance or restoration of the true colors and gradations of colors imparted by colored dyes, but also whiteness. As noted hereinabove, the hues of various colored dyes can be undesirably modified by metal cations, especially copper and nickel. Likewise, the optical brighteners commonly used to enhance the perception of whiteness and brightness in white fabrics can also be undesirably modified by exposure to metal cations, thereby causing white fabrics to have less apparent fluorescence, and to appear drab.

The improvement in color fidelity afforded by the present invention can be measured in several different ways. For example, panels of expert graders can visually compare fabrics treated in the manner of this invention with original fabrics and with fabrics which have been exposed to metal ions in an aqueous rinse bath. Differences and gradations in color (including whiteness) can be visually assessed and ranked according to Panel Score Units (PSU) using any suitable scale. For example, numerical PSU grades can be assigned on the basis of comments such as: "I see no difference between test samples and controls" (0); "I think I see a small difference"; "I know I see a small difference"; "I know I see a large difference"; and "I know I see a very large difference" (4). PSU data can be handled statistically, using conventional techniques.

Alternatively, various types of optical apparatus and procedures can be used to assess the improvement in color fidelity afforded by the present invention. Thus, Hunter Whiteness measurements or "delta E" derived from L, a, b or CIE L, a, b value as measured with a Hunterlab Color Quest 45/0 apparatus can be used. Standard texts may be referred to with regard to such procedures.

The invention herein employs ingredients which are known and commercially available, or which can be synthesized in the manner described in the literature.

Chelating Agents—The compositions and processes herein employ one or more copper and/or nickel chelating agents ("chelators"). Such water-soluble chelating agents can be selected from the group consisting of amino carboxylates, amino phosphonates, polyfunctional-substituted aromatic chelating agents and mixtures thereof, all as hereinafter defined. Without intending to be bound by theory, it is believed that the benefit of these materials is due in part to their exceptional ability to remove copper and nickel ions (as well as other cations such as manganese, iron, and the like) from rinse solutions by formation of soluble chelates. Surprisingly, these chelating agents also appear to interact with dyes and optical brighteners on fabrics which have already been undesirably affected by interactions with copper or nickel cations in the laundry process, with the attendant color change and/or drabness effects. By the present invention, the whiteness and/or brightness of such affected fabrics are substantially improved or restored.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

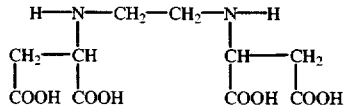

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. As noted hereinafter, at certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 99%, more preferably from about 0.75% to about 15%, by weight of the compositions herein. Preferred chelators include DETMP, DETPA, NTA, EDDS and mixtures thereof.

Chlorine Scavenger—Chlorine is used in many parts of the world to sanitize water. To ensure that the water is safe, a small residual amount, typically about 1 to 2 parts per million (ppm), of chlorine is left in the water. At least about 10% of U.S. households has about 2 ppm or more of chlorine in its tap water at some time. It has been found that this small amount of chlorine in the tap water can also contribute to fading or color changes of some fabric dyes. Thus, chlorine-induced fading of fabric colors over time can result from the presence of residual chlorine in the rinse water. Accordingly, in addition to the chelator, the present invention preferably also employs a chlorine scavenger. Moreover, the use of such chlorine scavengers provides a secondary benefit due to their ability to eliminate or reduce the chlorine odor on fabrics.

Chlorine scavengers are materials that react with chlorine, or with chlorine-generating materials, such as hypochlorite, to eliminate or reduce the bleaching activity of the chlorine materials. For color fidelity purposes, it is generally suitable to incorporate enough chlorine scavenger to neutralize about 1–10 ppm chlorine in rinse water, typically to neutralize at least about 1 ppm in rinse water. For the additional elimination or reduction of fabric chlorine odor resulting from the use of a chlorine bleach in the wash, the compositions should contain enough chlorine scavenger to neutralize at least about 10 ppm in rinse water.

Such compositions according to the present invention provide about 0.1 ppm to about 40 ppm, preferably from about 0.2 ppm to about 20 ppm, and more preferably from about 0.3 ppm to about 10 ppm of chlorine scavenger to an average rinse bath. Suitable levels of chlorine scavengers in the compositions of the present invention range from about 0.01% to about 10%, preferably from about 0.02% to about 5%, most preferably from about 0.03% to about 4%, by weight of total composition. If both the cation and the anion of the scavenger react with chlorine, which is desirable, the level may be adjusted to react with an equivalent amount of available chlorine.

Non-limiting examples of chlorine scavengers include primary and secondary amines, including primary and secondary fatty amines; ammonium salts, e.g., chloride, sulfate; amine-functional polymers; amino acid homopolymers with amino groups and their salts, such as polyarginine, polylysine, polyhistidine; amino acid copolymers with amino groups and their salts; amino acids and their salts, preferably those having more than one amino group per molecule, such as arginine, histidine, not including lysine reducing anions such as sulfite, bisulfite, thiosulfate, nitrite; antioxidants such as ascorbate, carbamate, phenols; and mixtures thereof. Ammonium chloride is a preferred inexpensive chlorine scavenger for use herein.

Other useful chlorine scavengers include water-soluble, low molecular weight primary and secondary amines of low volatility, e.g., monoethanolamine, diethanolamine, tris (hydroxymethyl)aminomethane, hexamethylenetetramine. Suitable amine-functional chlorine scavenger polymers include: water-soluble polyethyleneimines, polyamines, polyvinylamines, polyamineamides and polyacrylamides. The preferred polymers are polyethyleneimines, the polyamines, and polyamineamides. Preferred polyethyleneimines have a molecular weight of less than about 2000, more preferably from about 200 to about 1500.

Dye Transfer Inhibiting Agents—The compositions of the present invention may also include one or more materials effective for inhibiting the transfer of dyes from one fabric to another during the rinsing process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—Z; wherein Z is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

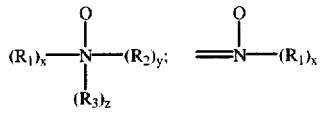

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the rinse added compositions and processes herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The compositions herein may also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

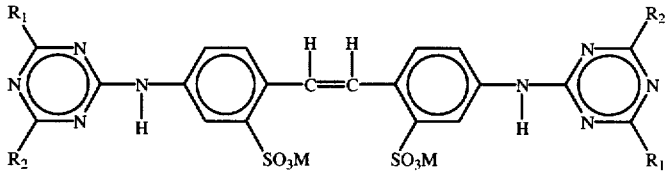

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous solutions than does either of these two components when used alone. Without being bound by theory, it is believed that such brighteners work this way because they have high affinity for fabrics in the aqueous solution and therefore deposit relatively quick on fabrics. The extent to which brighteners deposit on fabrics in solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally also be used in the present compositions to provide conventional fabric "brightness" benefits, rather than a true dye transfer inhibiting effect.

Cellulase Enzymes—As noted hereinabove, cellulase enzymes also contribute to overall fabric appearance improvements and can optionally be used in the present compositions. A wide variety of cellulase enzymes are known from the detergency, food and papermaking arts.

The cellulases usable in the compositions and processes herein can be any bacterial or fingal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of *Humicola insolens* (*Humicola grisea* var. *thermoidea*), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium. Preferred cellulases for use herein are characterized in that they provide at least 10% removal of immobilized radioactive labelled carboxymethyl-cellulose according to the $C^{14}$CMC-method described in EPA 350 098

(incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulases herein should be used in the compositions of the present invention at a level equivalent to an activity from about 0.1 to about 125 CEVU/gram of composition [CEVU=Cellulase (equivalent) Viscosity Unit, as described, for example, in WO 91/13136, incorporated herein by reference in its entirety], and most preferably about 5 to about 100. Such levels of cellulase are selected to provide the herein preferred cellulase activity at a level such that the compositions deliver an appearance-enhancing and/or fabric softening amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 1 CEVU's per liter rinse solution to about 50 CEVU's per liter rinse solution, more preferably from about 2 CEVU's per liter to about 30 CEVU's per liter, even more preferably from about 5 CEVU's per liter to about 25 CEVU's per liter, and most preferably from about 5 CEVU's per liter to about 15 CEVU's per liter.

The CAREZYME and BAN cellulases, such as those available from NOVO, are especially useful herein. If used, such commercial enzyme preparations will typically comprise from about 0.001% to about 2%, by weight, of the present compositions.

Fabric Softeners/Anti-stats—The compositions and processes herein may optionally also comprise one or more fabric softening or anti-static agents to provide additional fabric care benefits. If used, such ingredients will typically comprise from about 1% to about 35%, by weight, of the present compositions, but may comprise up to about 90% by weight of the compositions, or higher, in high concentrate or solid forms. The preferred fabric softening agents to be used in the present invention compositions are quaternary ammonium compounds or amine precursors herein having the formula (I) or (II), below.

(I)

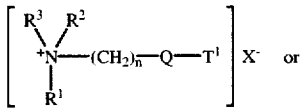

(II)

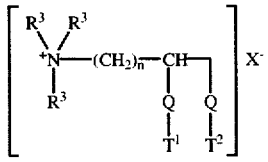

Q is —O—C(O)— or —C(O)—O— or —O—C(O)—O— or —$NR^4$—C(O)— or —C(O)—$NR^4$—; or mixtures thereof, e.g., an amide substituent and an ester substituent in the same molecule;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl)ammonium chloride or its corresponding amide (available as VARISOFT 222);
3) N,N-di(2-tallowyloxy-2-oxo-ethyl)-N,N-dimethyl ammonium chloride;
4) N,N-di(2-tallowyloxyethylcarbonyloxyethyl)-N,N-dimethyl ammonium chloride;
5) N-(2-tallowoyloxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyloxy-2-oxoethyl)-N-(tallowyl-N,N-dimethyl-ammonium chloride; and
8) 1,2-ditallowyl oxy-3-trimethylammoniopropane chloride; and mixtures of any of the above materials.

Of these, compounds 1–7 are examples of compounds of Formula (I); compound 8 is a compound of Formula (II).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentratability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleoyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For many of the preceding fabric softening agents, the pH of the compositions herein is an essential parameter of the present invention. Indeed, pH influences the stability of the quaternary ammonium or amine precursors compounds, and of the cellulase, especially in prolonged storage conditions.

The pH, as defined in the present context, is measured in the neat compositions, or in the continuous phase after separation of the dispersed phase by ultra centrifugation, at 20° C. For optimum hydrolytic stability of compositions comprising softeners with ester linkages, the neat pH, measured in the above-mentioned conditions, must be in the range of from about 2.0 to about 4.5, preferably about 2.0 to about 3.5. The pH of such compositions herein can be regulated by the addition of a Bronsted acid. With non-ester softeners, the pH can be higher, typically in the 3.5 to 8.0 range.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the present invention compositions are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from 1–3, preferably 1–2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. : 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference.

For example, suitable fabric softener agents useful herein may comprise one, two, or all three of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one said group and an arylalkyl group (preferably from about 10% to about 80%);

with said (a), (b) and (c) preferred percentages being by weight of the fabric softening agent component of the present invention compositions.

Following are the general descriptions of the preceding (a), (b), and (c) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of:

(i) the reaction product of higher fatty acids with hydroxy alkylalkylenediamines in a molecular ratio of about 2:1, said reaction product containing a composition having a compound of the formula:

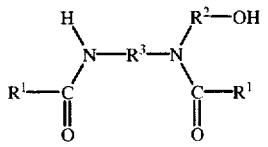

wherein $R^1$ is an acyclic aliphatic $C_{15}$–$C_{21}$ hydrocarbon group and $R^2$ and $R^3$ are divalent $C_1$–$C_3$ alkylene groups;

(ii) substituted imidazoline compounds having the formula:

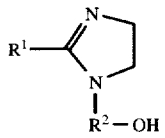

wherein $R^1$ and $R^2$ are defined as above;

(iii) substituted imidazoline compounds having the formula:

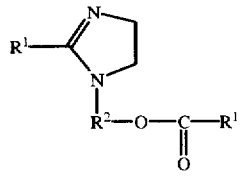

wherein $R^1$ and $R^2$ are defined as above;

(iv) the reaction product of higher fatty acids with di alkylenetriamines in a molecular ratio of about 2:1, said reaction product containing a composition having a compound of the formula:

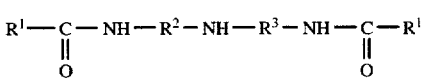

wherein $R^1$, $R^2$ and $R^3$ are defined as above; and (v) substituted imidazoline compounds having the formula:

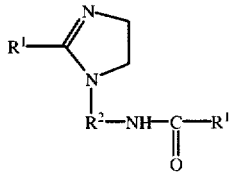

wherein $R^1$ and $R^2$ are defined as above; and (vi) mixtures thereof

Component (a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine is N-2-hydroxyethylethylenediamine, and $R^1$ is an aliphatic $C_{15}$–$C_{17}$ hydrocarbon group, and $R^2$ and $R^3$ are divalent ethylene groups.

An example of Component (a)(ii) is stearic hydroxyethyl imidazoline wherein $R^1$ is an aliphatic $C_{17}$ hydrocarbon group, $R^2$ is a divalent ethylene group; this chemical is sold under the trade names of Alkazine® ST by Alkaril Chemicals, Inc., or Schercozoline® S by Scher Chemicals, Inc.

An example of Component (a)(iv) is N,N"-ditallowalkoyldiethylenetriamine where $R^1$ is an aliphatic $C_{15}$–$C_{17}$ hydrocarbon group and $R^2$ and $R^3$ are divalent ethylene groups.

An example of Component (a)(v) is 1-tallowamidoethyl-2-tallowimidazoline wherein $R^1$ is an aliphatic $C_{15}$–$C_{17}$ hydrocarbon group and $R^2$ is a divalent ethylene group.

The Components (a)(iii) and (a)(v) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amido ethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallowalkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt containing one long chain acyclic aliphatic $C_{15}$–$C_{22}$ hydrocarbon group selected from the group consisting of:

(i) acyclic quaternary ammonium salts having the formula:

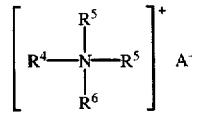

wherein $R^4$ is an acyclic aliphatic $C_{15}$–$C_{22}$ hydrocarbon group, $R^5$ and $R^6$ are $C_1$–$C_4$ saturated alkyl or hydroxy alkyl groups, and A– is an anion;

(ii) substituted imidazolinium salts having the formula:

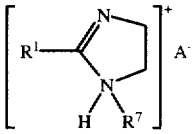

wherein $R^1$ is an acyclic aliphatic $C_{15}$–$C_{21}$ hydrocarbon group, $R^7$ is a hydrogen or a $C_1$–$C_4$ saturated alkyl or hydroxyalkyl group, and A– is an anion;

(iii) substituted imidazolinium salts having the formula:

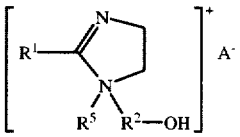

wherein $R^2$ is a divalent $C_1$–$C_3$ alkylene group and $R^1$, $R^5$ and A– are as defined above;

(iv) alkylpyridinium salts having the formula:

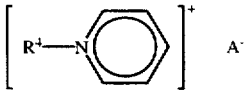

wherein $R^4$ is an acyclic aliphatic $C_{16}$–$C_{22}$ hydrocarbon group and A– is an anion; and (v) alkanamide alkylene pyridinium salts having the formula:

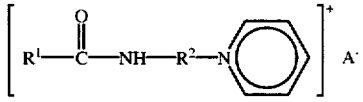

wherein $R^1$ is an acyclic aliphatic $C_{15}$–$C_{21}$ hydrocarbon group, $R^2$ is a divalent $C_1$–$C_3$ alkylene group, and A– is an ion group;

(vi) monoester quaternary ammonium compounds having the formula:

$$[(R)_3—N^+—(CH_2)_n—Y—R^2]A^-$$

wherein each Y=—O—(O)C—, or —C(O)—O—;

each n=1 to4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof;

$R^2$ is a $C_{10}$–$C_{22}$ hydrocarbyl, or substituted hydrocarbyl, substituent, preferably $C_{12}$–$C_{19}$ alkyl and/or alkenyl, most preferably $C_{12}$–$C_{18}$ straight chain alkyl and/or alkenyl (the shorter chains being more stable in the formulations); and the counterion, A–, can be any softener-compatible anion, for example, chloride, bromide, methylsulfate, formate, sulfate, nitrate and the like; and (vii) mixtures thereof.

Examples of Component (b)(i) are the monoalkyltrimethylammonium salts such as monotallowtrimethylammonium chloride, mono(hydrogenated tallow) trimethylammonium chloride, palmityltrimethyl ammonium chloride and soyatrimethylammonium chloride, sold by Sherex Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred.

Other examples of Component (b)(i) are behenyltrimethylammonium chloride wherein $R^4$ is a $C_{22}$ hydrocarbon group and sold under the trade name Kemamine® Q2803-C by Humko Chemical Division of Witco Chemical Corporation; soyadimethylethylammonium ethylsulfate wherein $R^4$ is a $C_{16}$–$C_{18}$ hydrocarbon group, $R^5$ is a methyl group, $R^6$ is an ethyl group, and A– is an ethylsulfate anion, sold under the trade name Jordaquat® 1033 by Jordan Chemical Company; and methyl-bis(2-hydroxyethyl)-octadecylammonium chloride wherein $R^4$ is a $C_{18}$ hydrocarbon group, $R^5$ is a 2-hydroxyethyl group and $R^6$ is a methyl group and available under the trade name Ethoquad® 18/12 from Armak Company.

An example of Component (b)(iii) is 1-ethyl-1-(2-hydroxy ethyl)-2-isoheptadecylimidazolinium ethylsulfate wherein $R^1$ is a $C_{17}$ hydrocarbon group, $R^2$ is an ethylene group, $R^5$ is an ethyl group, and A– is an ethylsulfate anion. It is available from Mona Industries, Inc., under the trade name Monaquat® ISIES.

An example of Component (b)(vi) is mono (tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl)dimethylammonium chloride, a (c) (vii) component (vide infra).

Component (c): Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

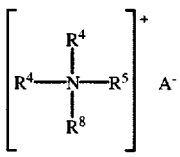

wherein $R^4$ is an acyclic aliphatic $C_{15}$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamido quaternary ammonium salts having the formula:

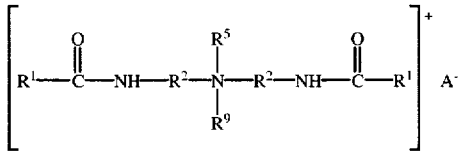

wherein $R^1$ is an acyclic aliphatic $C_{15}$–$C_{21}$ hydrocarbon group, $R^2$ is a divalent alkylene group having 1 to 3 carbon atoms, $R^5$ and $R^9$ are $C_1$–$C_4$ saturated alkyl or hydroxyalkyl groups, and A– is an anion;

(iii) diamino alkoxylated quaternary ammonium salts having the formula:

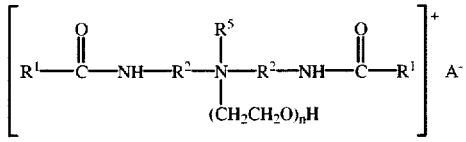

wherein n is equal to 1 to about 5, and $R^1$, $R^2$, $R^5$ and A– are as defined above;

(iv) quaternary ammonium compounds having the formula:

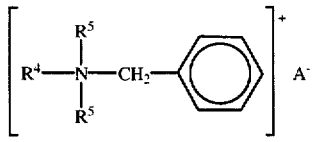

wherein $R^4$ is an acyclic aliphatic $C_{15}$–$C_{22}$ hydrocarbon group, $R^5$ is a $C_1$–$C_4$ saturated alkyl or hydroxyalkyl group, A– is an anion;

(v) substituted imidazolinium salts having the formula:

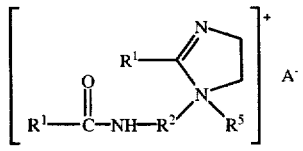

wherein $R^1$ is an acyclic aliphatic $C_{15}$–$C_{21}$ hydrocarbon group, $R^2$ is a divalent alkylene group having 1 to 3 carbon atoms, and $R^5$ and A– are as defined above; and (vi) substituted imidazolinium salts having the formula:

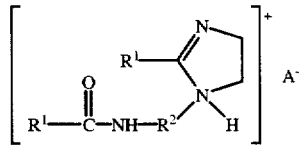

wherein $R^1$, $R^2$ and A– are as defined above;

(vii) diester quaternary ammonium (DEQA) compounds having the formula:

$$(R)_{4-m}—N^+—[(CH_2)_n—Y—R^2]_mA^-$$

wherein each Y=—O—(O)C—, or —C(O)—O—;

m=2or3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof, each $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, A–, can be any softener-compatible anion, for example, chloride, bromide, methylsulfate, formate, sulfate, nitrate and the like; and (viii) mixtures thereof.

Examples of Component (c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow) dimethylammonium chloride and ditallowdimethylammonium chloride are preferred. Examples of commercially available dialkyldimethyl ammonium salts usable in the present invention are di(hydrogenated tallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride wherein $R^4$ is an acyclic aliphatic $C_{22}$ hydrocarbon group is sold under the trade name Kemamine Q-2802C by Humko Chemical Division of Witco Chemical Corporation.

Examples of Component (c)(ii) are methylbis (tallowamido ethyl)(2-hydroxyethyl)ammonium methylsulfate and methylbis(hydrogenated tallowamidoethyl)(2-hydroxyethyl)ammonium methylsulfate wherein $R^1$ is an acyclic aliphatic $C_{15}$–$C_{17}$ hydrocarbon group, $R^2$ is an ethylene group, $R^5$ is a methyl group, $R^9$ is a hydroxyalkyl group and A– is a methylsulfate anion; these materials are available from Witco Chemical Company under the trade names Varisoft® 222 and Varisoft® 110, respectively.

An example of Component (c)(iv) is dimethylstearylbenzyl ammonium chloride wherein $R^4$ is an acyclic aliphatic $C_{18}$ hydrocarbon group, $R^5$ is a methyl group and A– is a chloride anion, and is sold under the trade names Varisoft® SDC by Witco Chemical Company and Ammonyx® 490 by Onyx Chemical Company.

Examples of Component (c)(v) are 1-methyl-1-tallowamido ethyl-2-tallowimidazolinium methylsulfate and 1-methyl-1-(hydrogenated tallowamidoethyl)-2-(hydrogenated tallow)imidazolinium methylsulfate wherein $R^1$ is an acyclic aliphatic $C_{15}$–$C_{17}$ hydrocarbon group, $R^2$ is an ethylene group, $R^5$ is a methyl group and A– is a chloride anion; they are sold under the trade names Varisoft® 475 and Varisoft® 445, respectively, by Witco Chemical Company.

It will be understood that for (c)(vii) above substituents R and $R^2$ can optionally be substituted with various groups such as alkoxyl or hydroxyl groups, and/or can be saturated, unsaturated, straight, and/or branched so long as the $R^2$ groups maintain their basically hydrophobic character. Preferred softening compounds are biodegradable such as those in Component (c)(vii). These preferred compounds can be considered to be diester variations of ditallow dimethyl ammonium chloride (DTDMAC), which is a widely used fabric softener.

The following are non-limiting examples of (c)(vii) (wherein all long-chain alkyl substituents are straight-chain):

$[CH_3]_2{}^+N[CH_2CH_2OC(O)R^2]_2Cl^-$ $[HOCH(CH_3)CH_2][CH_3]^+N[CH_2CH_2OC(O)C_{15}H_{31}]_2Br^-$ $[C_2H_5]_2{}^+N[CH_2CH_2OC(O)C_{17}H_{35}]_2Cl^-$ $[CH_3][C_2H_5]^+N[CH_2CH_2OC(O)C_{13}H_{27}]_2I^-$ $[C_3H_7][C_2H_5]^{+N[CH}{}_2CH_2OC(O)C_{15}H_{31}]_2{}^{-SO}{}_4CH_3$

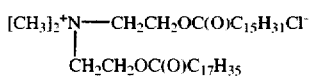

$[CH_2CH_2OH][CH_3]^+N[CH_2CH_2OC(O)R^2]_2Cl^-$ where —$C(O)R^2$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)dimethylammonium chloride.

Since some of the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. Ranges of pH for making stable softener compositions containing diester quaternary ammonium fabric softening compounds are disclosed in U.S. Pat. No. 4,767,547, Straathof and Konig, issued Aug. 30, 1988, and is incorporated herein by reference.

The diester quaternary ammonium fabric softening compound (DEQA) of (c)(vii) can also have the general formula:

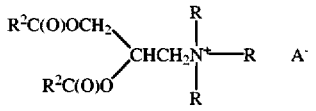

wherein each R, $R^2$, and $A^-$ have the same meanings as before. Such compounds include those having the formula:

$[CH_3]_3{}^+N[CH_2CH(CH_2OC(O)R^2)OC(O)R^2]Cl^-$ where —$OC(O)R^2$ is derived from soft tallow and/or hardened tallow fatty acids.

Preferably each R is a methyl or ethyl group and preferably each $R^2$ is in the range of $C_{15}$ to $C_{19}$. Degrees of branching, substitution and/or non-saturation can be present in the alkyl chains. The anion A– in the molecule is preferably the anion of a strong acid and can be, for example, chloride, bromide, sulphate, and methyl sulphate; the anion can carry a double charge in which case A– represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

A preferred composition contains Component (a) at a level of from about 10% to about 80%, Component (b) at a level of from about 3% to about 40%, and Component (c) at a level of from about 10% to about 80%, by weight of the fabric softening component of the present invention compositions. A more preferred composition contains Component (c) which is selected from the group consisting of: (i) di(hydrogenated tallow)dimethylammonium chloride; (v) methyl-1-tallowamidoethyl-2-tallowimidazolinium methylsulfate; (vii) ditallowylethanol ester dimethylammonium chloride; and mixtures thereof.

An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow)trimethyl ammonium chloride present at a level of from about 3% to about 30% by weight of the fabric softening component of the present invention compositions; Component (c): selected from the group consisting of di(hydrogenated tallow) dimethylammonium chloride, ditallowdimethylammonium chloride, methyl-1-tallowamidoethyl-2-tallowimidazolinium methyl sulfate, diethanol ester dimethylammonium chloride, and mixtures thereof; wherein Component (c) is present at a level of from about 20% to about 60% by weight of the fabric softening component of the present invention compositions; and wherein the weight ratio of said di(hydrogenated tallow)dimethylammonium chloride to said methyl-1-tallowamido ethyl-2-tallowimidazolinium methylsulfate is from about 2:1 to about 6:1.

The above individual components can also be used individually, especially those of I(c) (e.g., ditallowdimethylammonium chloride or ditallowylethanol ester dimethylammonium chloride).

In the cationic nitrogenous salts described hereinbefore, the anion A– provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A–. For liquid compositions the fabric softeners may be milled using conventional high shear milling equipment to increase product stability (phase separation) and softening efficacy due to the reduction of vesicle sizes in the finished product. Milled particles of 1 micron or less are preferred.

Stabilizers—The liquid compositions herein are preferably provided in homogeneous, thickened form for aesthetic or other reasons, according to the desires of the formulator. It has now been discovered that certain water-soluble polyester materials provide a valuable stabilizing effect for the compositions herein which contain a fabric softener ingredient. For example, when preparing compositions as disclosed hereinafter comprising an ester-linked fabric softener and a chelator such as EDDS in the presence of a zinc salt, it is preferred to use a co-polymer derived from dimethyl terephthalate, 1,2-propylene glycol and methyl-capped polyethylene glycol as a stabilizer to prevent the phase separation which can be caused by the presence of the electrolytes. Such stabilizers are also preferred when the finished compositions comprise more than about 10%, by weight, of cationic fabric softener and more than about 1%, by weight, of other dissolved electrolytes. Preferred stabilizers include the polyester materials disclosed in U.S. Pat. No. 4,702,857, Gosselink, issued Oct. 27, 1987. A highly preferred polyester stabilizer comprises about 5 terephthalate units in the "backbone" of the molecule, and about 40 units of ethylene oxide in the "tails". If used, such stabilizers will typically comprise from about 0.1% to about 1.5%, by weight of the compositions, sufficient to provide a stable viscosity of from about 30 cps to about 80 cps (Brookfield LVT Viscometer; Spindle #2; 60 rpm; room temperature, ca. 25° C.).

The compositions of the present invention may be provided in liquid or solid form for use in an aqueous bath. Water or water/alcohol is a typical carrier for liquid compositions, and will typically comprise up to about 95%, by weight, of the finished compositions. Solid, including granular, compositions may contain various granular fillers, especially water-soluble salts such as sodium sulfate. For liquids, the compositions may conveniently be formulated over the pH range of from about 3 to about 8. On dilution in the bath, the in-use pH will typically be in the range of about 6.0–6.5. It is to be understood that the formulation of liquid compositions comprising EDDS with the degradable (typically, ester containing) fabric softeners is not entirely routine, since a low product pH, generally in the range of 3.0–3.5, is required for optimal storage stability of the degradable softeners. Under such low pH conditions, the EDDS tends to form needle-like crystals in the compositions. If desired, such compositions can be adjusted to a pH as high as about 4.5 to resolubilize the EDDS. However, at this pH range the overall storage stability of the product will be compromised.

It has now been discovered that liquid compositions comprising EDDS at pH's in the acidic range of 3.0 to 3.5 can be formulated by the addition of water-soluble zinc salts to the compositions. In particular, zinc chloride, but also $ZnBr_2$ and $ZnSO_4$ can be used for this purpose. The mole ratio of zinc cation to EDDS is typically in the range from about 1:1 to about 2:1, preferably about 3:2. Thus, when properly formulated in the manner described hereinafter, the formation of EDDS needles will be minimized.

The following illustrates compositions and processes according to the present invention, but is not intended to be limiting thereof.

EXAMPLE I

A chelator composition suitable for use in a laundry rinse bath in the presence of chlorine comprises the following.

| Ingredient | % (Wt.) |
|---|---|
| DETPA* | 5.0 |
| $NH_4Cl$ | 0.5 |
| Water, perfume, minors | Balance |

*Diethylenetriaminepentaacetic acid, sodium salt.

EXAMPLE II

A chelator composition with fabric softening benefits and useful in the presence of chlorine comprises the following.

| Ingredient | % (Wt.) |
|---|---|
| DTDMAC | 7.0 |
| $NH_4Cl$ | 0.5 |
| DETPA | 5.0 |

-continued

| Ingredient | % (Wt.) |
|---|---|
| Surfactant* | 0.5 |
| Water and minors | Balance |

*$C_{12-14}$ alcohol ethoxylate EO(5)

EXAMPLE III

A granular mixed chelator composition suitable for use in an aqueous rinse bath comprises the following.

| Ingredient | % (Wt.) |
|---|---|
| Sodium citrate | 25 |
| DETMP* | 2 |
| Inert filler | Balance |

*May be replaced by an equivalent amount of ethylenediaminetetrakis (methylene phosphonate).

EXAMPLE IV

A biodegradable, non-phosphorus chelator composition is as follows.

| Ingredient | % (Wt.) |
|---|---|
| EDDS* | 5.0 |
| $NH_4Cl$ | 0.5 |
| Water and minors | Balance |

*[S,S]Isomer, Na salt

EXAMPLE V

A chelator composition with a polymeric dye transfer inhibitor is as follows.

| Ingredient | % (Wt.) |
|---|---|
| EDDS [S,S], Na salt* | 3.0 |
| PVP** | 1.5 |
| PVPVI | 1.5 |
| Water, minors | Balance |

*May be replaced by an equivalent amount of DETPA or DETMP.
**May be replaced by an equivalent amount of PVNO.

EXAMPLE VI

A chelator composition with an optical brightener serving as a dye transfer inhibitor is as follows.

| Ingredient | % (Wt.) |
|---|---|
| DETPA (Na) | 9.0 |
| TINOPAL-UNPA-GX | 0.2 |
| Water and minors | Balance |

EXAMPLE VII

A mixed chelator composition is as follows.

| Ingredient | % (Wt.) |
|---|---|
| DETPA, Na salt | 2.0 |
| Sodium citrate | 2.0 |
| Ammonium chloride | 3.0 |
| EDTA, Na salt | 1.0 |
| HEDP, Na salt | 0.75 |
| NTA, Na salt | 0.5 |
| Inert filler* | Balance |

*Sodium sulfate is convenient.

EXAMPLE VIII (A and B)

Rinse-added compositions with cellulase fabric care benefits are as follows:

| A | | B | |
|---|---|---|---|
| Ingredient | % (Wt.) | Ingredient | % (Wt.) |
| CAREZYME | 1.0 | CAREZYME | 0.7 |
| $NH_4Cl$ | 0.5 | $NH_4Cl$ | 0.5 |
| EDDS[S,S] | 3.5 | DETPA, Na | 4.5 |
| Water and minors | Balance | Water and minors | Balance |

EXAMPLE IX

A stable rinse-added liquid chelator composition with fabric softening properties is formulated as follows using biodegradable EDDS and a biodegradable fabric softener. The pH of the finished product, measured "as is" is 3.5.

| Ingredient | % (Wt.) |
|---|---|
| DEEDMAC* | 25 |
| EDDS[S,S], Na salt | 1.25 |
| $ZnCl_2$ | 0.75 |
| Polymer** | 0.5 |
| Water and minors*** | Balance |

*Ditallowalkyl ester of ethyldimethyl ammonium chloride; mainly dimethyl bis (stearoyl oxy ethyl) ammonium chloride.
**Stabilizer synthesized from dimethyl terephthalate, 1,2-propylene glycol and methyl capped polyethylene glycol as disclosed in the literature: see U.S. Pat. No. 4,702,857.
***Perfume, electrolyte, acidulant.

EXAMPLE X

A rinse-added liquid chelator composition comprising a biodegradable fabric softener and formulated at pH 3 to 3.5 to provide storage stability is as follows:

| Ingredient | % (Wt.) |
|---|---|
| DEEDMAC | 25 |
| DETPA, Na | 2.5 |

-continued

| Ingredient | % (Wt.) |
|---|---|
| Polymer* | 0.5 |
| Water and minors** | Balance |

*Polymer as in Example IX.
**Perfume, electrolyte, acidulant.

EXAMPLE XI

DEEDMAC stock is liquefied in a 76° C. water bath. Separately, the free water in the composition, also containing silicone anti-foam agent and about 0.02 parts HCl, is heated to 76° C. in a sealed container. The DEEDMAC stock is slowly transferred to the aqueous portion while under agitation from a turbine mixer at 72–75° C. 1.2 parts of a 25% (aq.) $CaCl_2$ solution is dripped into the dispersion to transform it from a viscous paste to a thin fluid. The system is then high shear milled for two minutes at 55° C. using a rotor-stator probe element. Under moderate agitation, the system is brought to room temperature within five minutes by immersion in an ice bath.

The following ingredients are sequentially added to the product under moderate agitation at room temperature:

1.25 parts of a 40% solution of polymer (as per Example IX);

A blend of 6.1 parts of a 41% solution of NaDETPA with 1.5 parts conc. HCl;

Up to 1.35 parts Perfume;

0.1 parts Ammonium chloride;

Up to 0.5 parts CAREZYME solution (optional);

2.8 parts of a 25% aq. $CaCl_2$ solution.

Sufficient time of mixing is allowed to promote the diffusion of perfume into the DEEDMAC vesicles. This is proportional to the batch size. The order of addition of the above ingredients is critical to the physical stability of the final dispersion. The perfume addition should precede the $CaCl_2$. The polymer addition should precede the addition of chelant and preferably the other electrolytes. When pH-sensitive softeners are used, the chelant should be blended with acid or base close to the pH of the softener to avoid localized pH shifts which can impact softener stability and affect the viscosity stability of the product. The finished product contains 2.5% DETPA.

EXAMPLE XII

When preparing a liquid product comprising the DEEDMAC softener and EDDS chelator, the following modification of Example XI is used.

1. $MgCl_2$ is generally used instead of $CaCl_2$ in the composition. 1.0 parts of a 25% aq. solution of $MgCl_2$ is dripped into the hot dispersion prior to milling, and a equal amount of this salt is added as the final step in product making.
2. In place of DETPA/HCl addition, a blend of 3.8 parts of a 33% aq. NAEDDS solution with 1.25 to about 1.50 parts of a 50% aq. $ZnCl_2$ solution are added to the product under moderate agitation after the polymer addition. The finished product contains 1.25% EDDS.

The compositions herein may optionally contain various other ingredients, including but not limited to: dyes; antifoams (typically, silicone antifoams such as Dow Corning 2210); preservatives such as KATHON; and the like. Such ingredients typically comprise from about 0.01% to about 1% of the total compositions herein. In order to avoid extraneous metal cations and electrolytes, the compositions are preferably formulated using deionized water. If alcohols such as ethanol are used, they typically comprise about 5%, or less, by weight of the compositions.

The process of the present invention is typically and conveniently conducted by contacting the fabrics to be treated with an aqueous medium containing any of the foregoing comprising the chelating agent, which is typically used in the aqueous medium at levels of at least about 2 ppm, typically from about 5 ppm to about 25 ppm. (Higher levels of the chelator, e.g., 50–1000 ppm may be employed at the option of the user.) Contact between the fabrics and the treatment solution can be conducted by any convenient method, including sprays, padding on, spot treatment or, preferably, by immersing the fabrics in an aqueous bath containing the chelator, and other optional ingredients, i.e., a typical aqueous rinse bath at about 70° F. (20° C.) at a pH typically of about 6.5–8.0 for at least about 1 minute, conveniently from about 1 minute to about 10 minutes, following an otherwise conventional laundering operation. Depending somewhat on the type of dye and the amount of metal cations undesirably associated therewith, the compositions and processes herein will typically provide a substantial visual improvement in color fidelity in the range of 2–4 PSU.

While the foregoing Examples illustrate the processes and compositions herein, they are not intended to be limiting thereof. Compositions especially adapted for use in the rinse bath of an aqueous laundering operation, and which provide improved color fidelity include, but are not limited to compositions which comprise:

(a) at least about 0.5%, by weight, of a chelating agent for copper cations, nickel cations, or mixtures thereof; especially DETPA, DETMP or EDDS;

(b) at least about 0.01%, by weight, of a chlorine scavenger, especially ammonium chloride;

(c) optionally, a fabric softener, especially a biodegradable, ester-linked cationic fabric softener;

(d) optionally, a cellulase enzyme; and (e) optionally, a dye transfer inhibiting agent.

Other preferred compositions herein comprise:

(a) a biodegradable, ester linked fabric softener;

(b) a biodegradable ethylenediamine disuccinate chelating agent;

(c) a source of zinc cations, such as a water-soluble zinc salt; and (d) a liquid carrier;

said compositions being formulated at a pH of about 3.5 or below to provide stability for the fabric softener ingredient.

The aforesaid compositions can comprise the additional ingredients disclosed herein as well as other ingredients without departing from the spirit and scope of the present invention.

What is claimed is:

1. A composition of matter especially adapted for use in the rinse bath of a laundering operation, comprising:

(a) at least about 0.75%, by weight, of chelating agent for copper cations, nickel cations, or mixtures thereof;

(b) more than about 10%, by weight, of cationic fabric softener;

(c) stabilizer selected from the group consisting of polyester material, water-soluble zinc salt, and mixtures thereof;

(d) optionally, dissolved electrolytes;

(e) optionally, at least about 0.01%, by weight, of chlorine scavenger;

(f) optionally, cellulase enzyme; and (g) optionally, dye transfer inhibiting agent.

2. A composition according to claim 1 wherein the chelating agent is ethylenediamine disuccinate and the chlorine scavenger is ammonium chloride.

3. A composition according to claim 1 wherein the chelating agent is diethylenetriamine pentaacetate and the chlorine scavenger is ammonium chloride.

4. A composition according to claim 1 wherein the chelating agent is diethylenetriamine-N,N,N',N",N"-pentakis (methane phosphonate) and the chlorine scavenger is ammonium chloride.

5. A method for improving the color fidelity of laundered fabrics, comprising the steps of:

(a) washing dyed fabrics with a laundry detergent composition; and (b) following said washing, rinsing said fabrics in an aqueous solution comprising the composition of claim 1 in an amount sufficient to provide at least about 2 ppm of a chelating agent for copper ions or nickel ions selected from the group consisting of amino carboxylates, amino phosphonates, polyfunctionally-substituted aromatic chelating agents and mixtures thereof.

6. A method according to claim 5 wherein the dyed fabrics are immersed in the aqueous soltuion of Step (b) for a period of at least about 1 minute.

7. A method according to claim 6 which is conducted at a temperature in the range from about 5° C. to the boil.

8. A method according to claim 5 wherein the aqueous solution additionally contains a member selected from the group consisting of cellulase enzymes, chlorine scavengers, dye transfer inhibiting agent and mixtures thereof.

9. A method according to claim 8 which is conducted in the presence of a dye transfer inhibiting agent selected from the group consisting of polyvinyl pyrrolidone polymers, polyamine N-oxide polymers, copolymers of N-vinylpyrrolidone and N-vinylimidazole, manganese phthalocyanine, peroxidases, and mixtures thereof.

10. A method according to claim 8 which is conducted in the presence of a chlorine scavenger selected from the group consisting of ammonium chloride, monoethanolamine, diethanolamine, tris(hydroxymethyl)aminomethane, hexamethylenetetramine, arginine, histidine, polyarginine, polylysine, polyhistidine, water-soluble polyethyleneimines, polyamines, polyvinylamines, polyamineamides, polyacrylamides, and mixtures thereof.

11. A method according to claim 10 which is conducted in the presence of a cellulase enzyme.

12. A method according to claim 8 which is conducted in the presence of an ester-derived cationic softener selected from the group consisting of compounds having the formula (I) and (II), below:

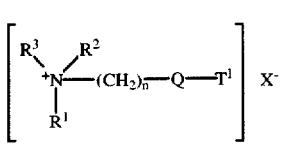

(I)

-continued (II)

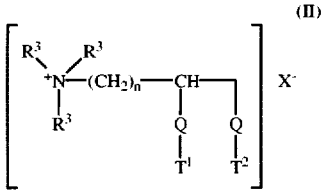

wherein Q is —O—C(O)— or —C(O)—O— or —O—C(O)—O— or —$NR^4$—C(O)— or —C(O)—$NR^4$—; or mixtures thereof;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are the same or different $C_{11}$–$C_{22}$ alkyl or alkenyl group;

n and m are integers from 1 to 4; and $X^-$ is a softener-compatible anion.

* * * * *